United States Patent [19]

Karliner et al.

[11] Patent Number: 4,652,163

[45] Date of Patent: Mar. 24, 1987

[54] LIQUID APPLICATOR WITH SCRAPER AND METHOD OF USE

[75] Inventors: Rudolf Karliner, Minnetonka, Minn.; Corbett W. Stone, S. Salem, N.Y.

[73] Assignee: Wagner Spray Tech Corporation, Minneapolis, Minn.

[21] Appl. No.: 730,263

[22] Filed: May 6, 1985

Related U.S. Application Data

[63] Continuation-in-part of Ser. No. 629,229, Jul. 9, 1984, abandoned.

[51] Int. Cl.[4] ..... B05C 17/00; B05C 17/10; A47L 13/03; A47L 13/16

[52] U.S. Cl. ..... 401/195; 401/16; 401/23; 401/193; 401/196; 401/202; 401/123

[58] Field of Search ..... 401/18, 23, 25, 27, 401/37, 38, 139, 195, 206, 193, 196, 202, 123

[56] References Cited

U.S. PATENT DOCUMENTS

| | | | |
|---|---|---|---|
| 817,890 | 4/1906 | Williams . | |
| 1,407,955 | 2/1922 | Smalley . | |
| 1,813,615 | 7/1931 | Frazier | 401/18 X |
| 2,716,250 | 8/1955 | Deakers . | |
| 2,869,168 | 1/1959 | Morneault | 401/18 |
| 2,886,839 | 5/1959 | Leopoldi | 401/139 |
| 2,943,338 | 7/1960 | Lowen . | |
| 2,982,987 | 5/1961 | Knapp . | |
| 3,084,375 | 4/1963 | Schwartzman . | |
| 3,091,374 | 5/1963 | Schwartzman . | |
| 3,129,452 | 4/1964 | Schwartzman . | |
| 3,133,300 | 5/1964 | Freeman . | |
| 3,135,988 | 6/1964 | Schwartzman | 401/206 |
| 3,184,781 | 5/1965 | Hoxie . | |
| 3,185,351 | 5/1965 | Klun . | |
| 3,192,553 | 7/1965 | Schwartzman . | |
| 3,196,479 | 7/1965 | Romoser . | |
| 3,203,026 | 8/1965 | Schwartzman . | |
| 3,351,969 | 11/1967 | Cline . | |
| 3,378,330 | 4/1968 | Schwartzman . | |
| 3,459,482 | 8/1969 | Fears . | |
| 3,459,483 | 8/1969 | Brastad . | |
| 3,508,933 | 4/1970 | Yates . | |
| 3,565,294 | 2/1971 | Schwartzman | 401/206 X |
| 3,565,541 | 2/1971 | Vallis . | |
| 3,653,779 | 4/1972 | Schwartzman . | |
| 3,744,922 | 7/1973 | Fears . | |
| 3,782,600 | 1/1974 | Columbus | 401/195 X |
| 3,836,371 | 9/1974 | Kokoszka . | |
| 3,837,747 | 9/1974 | Seymore | 401/25 |
| 3,890,271 | 6/1975 | Kokoszka . | |

*Primary Examiner*—Steven A. Bratlie

*Attorney, Agent, or Firm*—Hill, Van Santen, Steadman & Simpson

[57] ABSTRACT

A liquid applicator and scraper for applying a protective thin film of hardenable wax to glass during painting so that the surrounding area can be painted and the protective coating subsequently removed has a liquid container with a valve assembly for discharging the liquid to a sponge upon the application of pressure to the sponge, a blade unit which fits over the portion of the liquid container on which the sponge is mounted, the blade unit having a scraper blade affixed therein for removing the protective coating of wax after painting, and a cap for covering the portion of the blade unit in which the blade is affixed. The cap, the blade unit, and the liquid container, when assembled, form a single applicator and scraper unit with all components contained in one assembly.

37 Claims, 10 Drawing Figures

LIQUID APPLICATOR WITH SCRAPER AND METHOD OF USE

This is a continuation-in-part of application Ser. No. 629,229, filed July 9, 1984, now abandoned.

BACKGROUND OF THE INVENTION

1. Field of the Invention

The present invention relates to applicators and scraping devices, and in particular to a combination liquid applicator and scraper.

2. Description of the Prior Art

A problem in the field of interior and exterior building painting is that of masking portions of the building during painting which are not desired to be covered with paint, such as windows. In particular this problem arises when painting trim surrounding windows wherein the paint applicator must deposit paint immediately adjacent to the glass. The conventional solution to this problem is to cover the areas for which protection is desired with masking tape or, in large surface painting operations such as spray painting, to cover the window completely with paper or plastic affixed by tape or some other means.

SUMMARY OF THE INVENTION

It is an object of the present invention to provide a single unit having an applicator and a scraper for applying and removing a protective coating to surfaces such as glass which are not desired to be covered with paint during a painting operation.

It is another object of the present invention to provide such a combined applicator and scraper in a single hand-held unit.

It is a further object of the present invention to provide such a hand-held unit wherein all parts can be stored together in a compact closed assembly.

The above objects are inventively achieved in a combination applicator and scraper assembly having a liquid container with a valve assembly for regulating flow of liquid from the container to a sponge upon the application of pressure to the sponge, a removable blade unit which is press fit over the sponge for storage and which can be removed to expose the sponge to apply the liquid, and a cap which is also press fit to cover the blade of the blade unit during storage, and which can be removed to expose the blade. All three pieces are designed with the same exterior dimensions so that when assembled for storage a single compact unit results.

The applicator is used by rubbing the sponge along a surface, such as glass, to be protected so as to discharge a thin film of liquid wax or other suitable protective material onto the surface. The discharged liquid hardens to form a thin protective covering over the surface. The surrounding area can then be painted, sealed, varnished, or otherwise covered by any desired agent without danger of the agent coming into contact with the protected surface. After the paint or other material has been applied and is allowed to dry, the blade unit is placed over the sponge and the liquid container serves as a handle to run the flat edge of the blade along the service to remove the thin layer of hardened wax therefrom.

DESCRIPTION OF THE PREFERRED EMBODIMENTS

Figure 1:
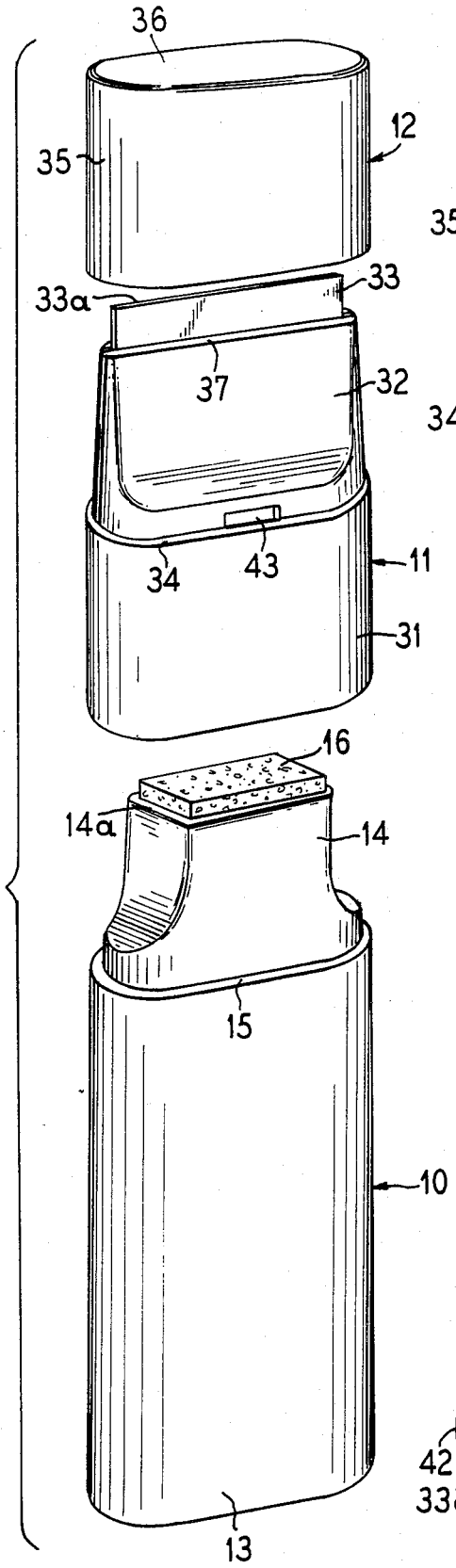
FIG. 1 is an exploded perspective view of a combination liquid applicator and scraper constructed in accordance with the principles of the present invention.
Figure 2:
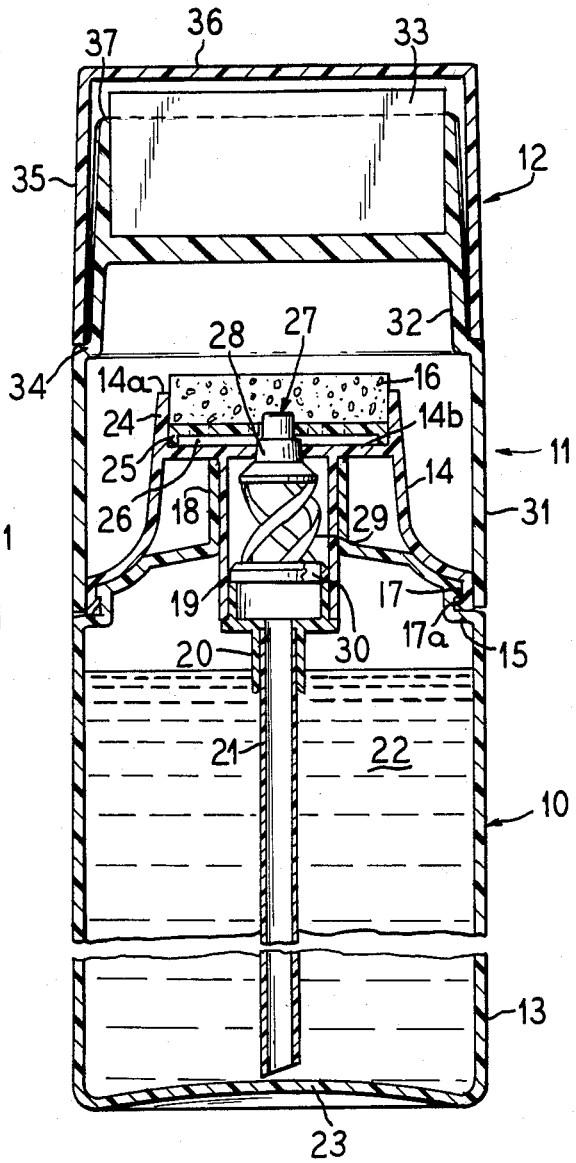
FIG. 2 is a sectional view of an assembled liquid applicator and scraper constructed in accordance with the principles of the present invention.

A combination liquid applicator and scraper constructed in accordance with the principles of the present invention is shown in unassembled form in FIG. 1 and in assembled form in FIG. 2. The unit basically consists of three main components, a liquid container 10, a blade unit 11, and a cap 12. The liquid container 10, which also functions as an applicator unit, has a container portion 13 comprised of, for example, plastic, and an applicator portion 14 which may also be comprised of plastic. The exterior of the top of the container portion 13 terminates in a flat rim 15, and the top of the applicator portion 14 terminates in a rim **14*a*. A sponge 16 is carried in the applictor portion 14**.

As shown in greater detail in FIG. 2, the container portion 13 has a flange 17 which forms a recess for receiving a complementary flange **17*a* carried on the bottom of the applicator portion 14 for joining those parts together. The container portion 13 also has a generally circular vertical wall 18 for receiving a housing 19 which is integrally formed as part of the applicator portion 14. The housing 9 has a lower portion terminating in a socket 20 which receives a conduit 21 extending through liquid 22 contained in the container portion 13. The conduit 21 extends substantially to the curved base 23 of the container portion 13**.

The housing 19 contains a valve assembly 27 having a nozzle 28 and a coil spring 29. The valve assembly 27 may, for example, also be comprised of plastic and may be a valve assembly of the type, for example, manufactured by Dab-O-Matic as described in one or more of U.S. Pat. Nos. 3,084,375; 3,091,374; 3,129,452; 3,192,553; 3,203,026; 3,378,330 or 3,653,779.

Figure 4:
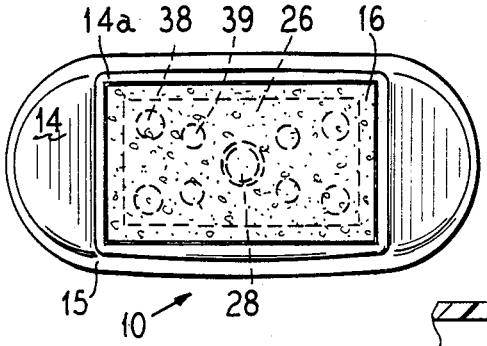
FIG. 4 is a plan view of the liquid container of the combination liquid applicator and scraper shown in FIG. 1.
Figure 5:
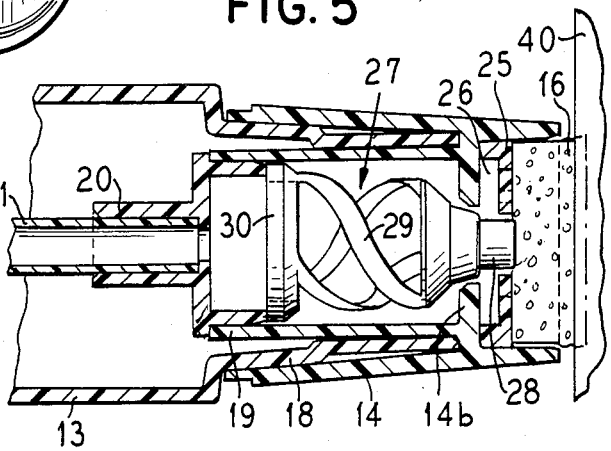
FIG. 5 is a fragmentary detailed view, partly in section, of the top of the liquid applicator shown in position for applying liquid to a surface.

Upon depression of the nozzle 28 by virtue of pushing the sponge 16 against a surface 40, as shown in FIG. 5, liquid is permitted to flow through the conduit 21, through a valve seat 30, and into a reservoir 26. The reservoir 26 is formed by another wall **14*b* integrally formed as part of the applicator portion 14 and a baffle 25. The baffle 25 and the sponge 16 supported thereon are received in a receptacle formed by an upstanding flange 24, also integrally formed as part of the applicator portion 14. As shown in FIG. 4, the baffle 25 has a plurality of spaced holes 38 and 39 therein which may, for example, be of different sizes. Liquid contained in the reservoir 26 flows through the holes 38 and 39 in the baffle 25 and saturates the sponge 16, thereby permitting a thin film of the liquid to be applied to the surface 40**.

In general, the liquid 22 is a hardenable wax of the type suitable as a car cleaner-polish. Two suitable compositions and methods of preparations for the liquid 22 are described below.

The first composition includes the following ingredients:

| Ingredients | Parts by Weight |
|---|---|
| UNION CARBIDE ® Silicone Fluid L-45 (435cSt) | 4.0 |
| UCAR ® Silicone AFL-40 | 2.0 |
| Wax S (available from American Hoechst, Somerville, New Jersey) | 2.0 |
| Mineral Spirits | 15.0 |
| Kerosene | 15.0 |
| Oleic Acid | 2.0 |
| Water (distilled or equivalent) | 45.9 |
| Morpholine | 1.1 |
| Kaopolite 1152 (available from Kaopolite Inc., Elizabeth, New Jersey) | 10.0 |
| Carbopol 934 (2% in water, available from B. F. Goodrich, Cleavland, Ohio) | 3.0 |
| | 100.0 |

The above ingredients are prepared as follows: The oleic acid, silicone fluid L-45, Wax S, and one-half of the mineral spirits and kerosene are combined and heated to 90° C. to melt the wax and obtain a clear solution. The morpholine is added with vigorous agitation. The silicone AFL-40 is added to the remainder of the mineral spirits and kerosene and the resulting mixture is combined with the above ingredients at 90° C. The Kaopolite 1152 is slurried into the water and the slurry is added to the hot solvent solution. Agitation is continued until a uniform blend is obtained. The Carbopol 934 is added with good agitation until a uniform mixture is obtained. The mixture is removed from the heat and mixing is continued until the mixture cools.

Another suitable composition as the following ingredients:

| Ingredients | Parts by Weight |
|---|---|
| Dow Corning ® 536 Fluid | 1.0 |
| Dow Corning ® 531 Fluid | 6.0 |
| Witcamide ® 511 (available from Witco Chemical Co.) | 1.0 |
| Stoddard Solvent | 22.0 |
| Kaopolite ® SF-0 (available from Kaopolite Inc., Elizabeth, New Jersey) | 10.0 |
| Water | 60.0 |
| | 100.0 |

The above ingredients are prepared as follows: Half of the solvent is loaded into a mixing vessel and agitation is begun. The Dow Corning ®536 Fluid, Dow Corning ®531 Fluid and Witcamide 511 are added to the mixing vessel in that order. The remainder of the solvent is then loaded into the vessel, which will clean the pumping lines. When the mix is uniform, the Kaopolite ®SF-0 is added and mixing is continued until the mix is again uniform. The water is added slowly and mixing is continued until the mixture is visibly thickened to the viscosity of light cream. Filtering is not necessary.

In the second composition, solvents other than Stoddard may be utilized. Substitution will depend upon the desired drying rate. Kerosene or Isopar ®L and Isopar ®M (available from the Humble Oil Co.) are also suitable for use as solvents.

Suitable liquid compositions and preparations are also disclosed in U.S. Pat. Nos. 3,960,575; 3,960,574; 3,544,498 and 3,508,933.

Figure 3:
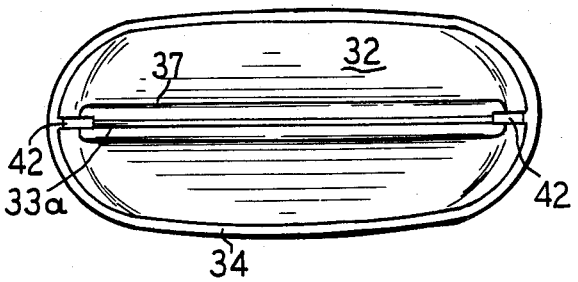
FIG. 3 is a plan view of the blade unit for the combination liquid applicator and scraper shown in FIG. 1.
Figure 6:
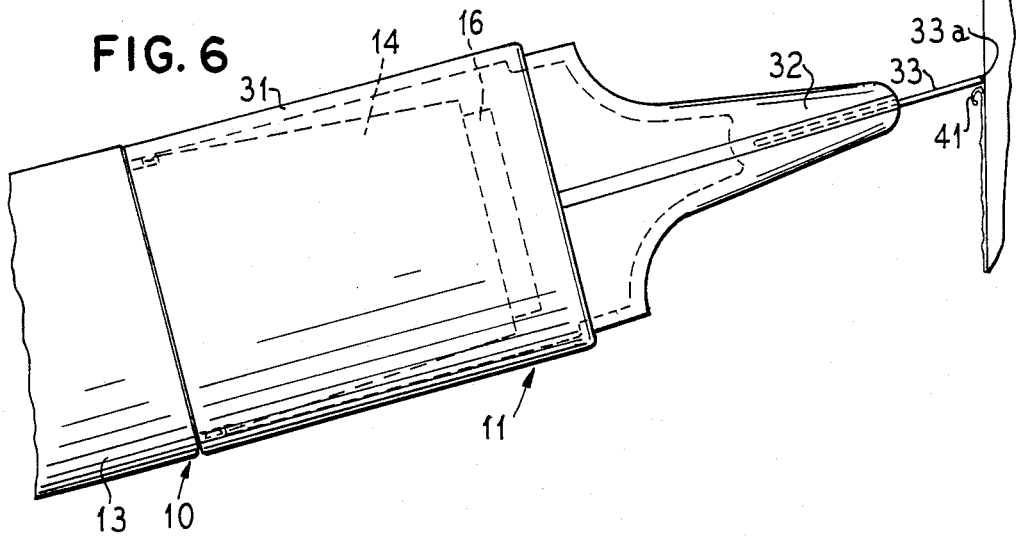
FIG. 6 is a fragmentary side view of the combination liquid applicator and scraper shown with the blade unit positioned for removing a thin layer of hardened wax from a surface.

After the liquid polish or wax has been applied and the painting operation as been concluded, the hardened thin film of wax 41 is scraped away by the flat edge **33*a* of the blade 33 as shown in FIG. 6. The blade 33 is held in a tapered upper portion 32 of the blade unit 11, which terminates in an upper rim 37 surrounding the blade 33. As shown in FIG. 3, the blade 33 is ultrasonically welded at locations such as 42 so as to be permanently retained in the tapered portion 32. A lower portion 31 of the blade unit 11 has a hollow interior and has an interior diameter selected so as to retain the blade unit 11 over the applicator portion 14 of the liquid container 10** by press fit.

Figure 7:
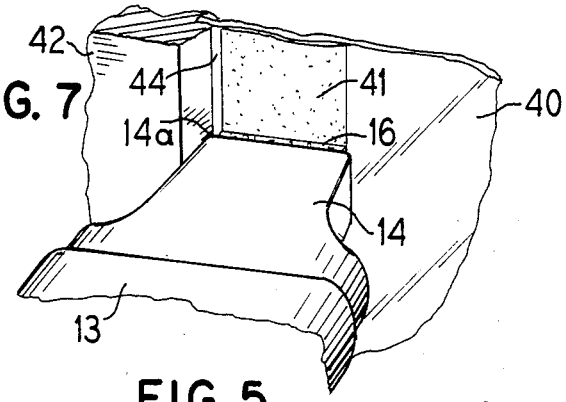
FIG. 7 is a perspective view of a method for applying a masking compound to a windowpane with an offset from the frame in accordance with the principles of the present invention.
Figure 8:
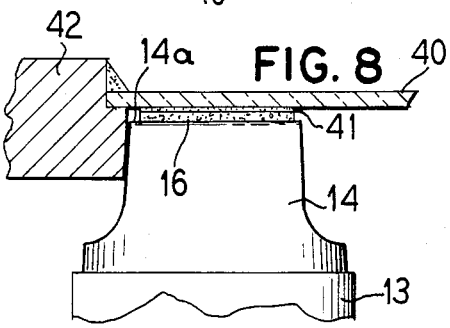
FIG. 8 is a plan view of the application of a masking compound in accordance with the principles of the present invention as shown in FIG. 7.

Application of a film 41 to a surface 40, such as a windowpane, is shown in FIG. 7. The windowpane 40 is held in a frame 42. The film 41 is applied by the sponge 16, functioning as an applicator surface. The outer edge of the applicator portion 14 is run along and in contact with the window frame 42. Because of the rim **14*a*, the film 41 is applied to the pane 40 at a slight distance from the edge of the frame 42, leaving a gap 44 of exposed, uncovered glass. Application of the film 41 in this manner is shown from above in FIG. 8**.

Figure 9:
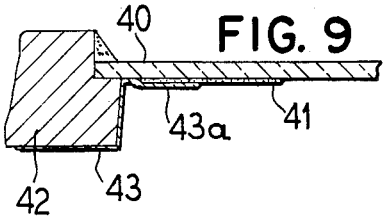
FIG. 9 is a plan view showing the masking compound hardened in place on a windowpane and a layer of paint partially overlapping the compound.
Figure 10:
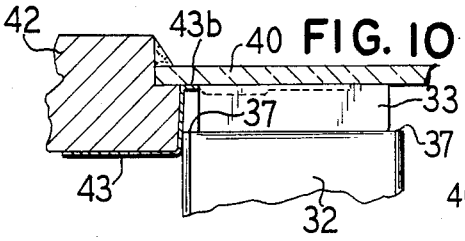
FIG. 10 is a plan view showing removal of the hardened compound and a portion of the paint overlying the compound.

The pane 40 with the hardened film layer 41 thereon is shown in FIG. 9 after coating the frame 42 with a layer 43 of flowable material, such as paint. The coating 43 has a portion **43*a* which has been deliberately during the application of the coating 43 been permitted to extend over the gap 44 and partially covers the film 41. Removal of the film 41, with the partial covering of paint, is shown on FIG. 10 using the blade 33. As described above, the blade 33 is held in the tapered portion 32 of the blade unit 11 and is slightly offset from the edges thereof by a rim 37. In a manner similar to application of the film 41, the edge of the tapered portion 32 is run along and in contact with the frame 42, thereby removing the film 41 and the partial covering of paint thereon, while leaving a covering of paint or other flowable liquid 43*b* in the gap. This bordering covering is deliberately left on the pane 40 in order to provide a seal between the pane 40 and the frame 42**.

The width of the rims **14*a* and 37 is approximately the same, and may be approximately 1/32 of an inch. The border 43*b*** will thus also be approximately 1/32 of an inch in width.

When not in use, the blade unit 11 is covered by the cap 12. The cap 12 has a continuous wall 35 which surrounds the tapered portion 32 of the blade unit 11 as well as the exposed portion of the blade 33. The cap 12 has a flat top 36. The cap 12 has a hollow interior and is seated on an upper rim 34 of the lower portion 31 of the blade unit 11 and has an interior diameter so as to be retained thereon by press fit. Additionally, the tapered portion 32 carries a detent 43 which receives a complementary shaped tab (not shown) carried on the interior of the cap 12 so as to further lock the cap 12 to the blade unit 11.

Although modifications and changes may be suggested by those skilled in the art, it is the intention of the inventors to embody within the patent warranted hereon all changes and modifications as reasonably and properly come within the scope of their contribution to the art.

We claim as our invention:

1. A device for applying and removing a hardenable liquid to a surface comprising in combination:

an applicator means having a container for said liquid and a liquid discharge means communicating with said container and having an applicator surface for discharging said liquid in a thin film onto said surface upon direct contact of said applicator surface therewith; and a scraper means having a blade mount with a blade therein for removing said liquid film from said surface after said liquid film has hardened thereon, said blade mount having a hollow interior for removeably receiving and covering said discharge means.

2. A device as claimed in claim 1 wherein said liquid discharge means comprises an exposed sponge carried on said applicator means and a valve means disposed inside said applicator means for supplying liquid to said sponge upon the application of external pressure to said sponge.

3. A device as claimed in claim 2 wherein said applicator means has a horizontal wall and wherein said sponge is supported on a baffle having a portion spaced from said wall forming a liquid reservoir therebetween.

4. A device as claimed in claim 2 wherein said applicator means has a chamber integrally formed thereon for receiving said valve means.

5. A device as claimed in claim 1 wherein said applicator means further has a liquid discharge means mount for supporting said liquid discharge means.

6. A device as claimed in claim 5 wherein said container has a recess deposed at an upper exterior thereof and wherein said liquid discharge means mount has a flange received and retained in said recess for joining said liquid discharge means mount and said container.

7. A device as claimed in claim 1 wherein said scraper means is press fit over a portion of said applicator means.

8. A device as claimed in claim 1 wherein said blade has a flat scraping edge.

9. A device as claimed in claim 1 further comprising a hollow cap for receiving and covering a portion of said scraper means.

10. A device as claimed in claim 9 wherein said cap is press fit over a portion of said scraper means.

11. A device as claimed in claim 1 wherein said blade is ultrasonically welded to said blade mount.

12. A device for applying and removing a hardenable liquid to a surface comprising in combination:

a first portion having a container for said liquid, an applicator surface carried on an upper portion of said first portion for applying said liquid to said surface, and a means for supplying liquid from said container to applicator surface;

a second portion having a receptacle for removeably receiving said upper portion of said first portion and covering said applicator surface, said second portion carrying a scraper blade on an upper portion thereof for removing said liquid from said surface after said liquid has hardened thereon; and a third portion for removeably receiving said upper portion of said second portion and covering said scraper blade.

13. A device as claimed in claim 12 wherein said means for applying said liquid to said surface is a sponge.

14. A device as claimed in claim 12 wherein said means for supplying liquid to said means for applying is a valve.

15. A device for applying and removing a hardenable liquid to a surface comprising in combination:

a first unit consisting of a liquid container, an applicator carrying an exposed sponge, a valve for supplying said liquid from said liquid container to said sponge upon the application of external pressure to said sponge, and a mounting means in which said sponge and said valve are supported;

a second unit having a lower hollow portion for removeably receiving and covering said exposed sponge, said lower portion being press fit with said mounting means, and having a blade carried in a blade mount for removing said liquid from said surface after said liquid has hardened thereon; and a cap for removeably receiving and covering said blade and said blade mount, said cap being press fit on said blade mount.

16. A device as claimed in claim 15 wherein said mounting means further comprises a horizontal wall and a baffle spaced therefrom on which said sponge is supported, said horizontal wall and said baffle forming a liquid reservoir therebetween.

17. A device as claimed in claim 15 wherein said container has a continuous recess at an upper portion thereof and wherein said mounting means has a continuous flange at a lower portion thereof for joining said mounting means and said container.

18. The device of claim 1 wherein said applicator means has sidewalls and wherein said applicator surface is offset from said sidewalls.

19. The device of claim 18 wherein said applicator means has a rim surrounding said applicator surface, said rim defining said offset.

20. The device of claim 1 wherein said blade mount has sidewalls and wherein said blade is offset from said sidewalls.

21. The device of claim 20 wherein said blade mount has a rim surrounding said blade, said rim defining said offset.

22. The device of claim 12 wherein said upper portion of said first portion has sidewalls, and wherein said applicator surface is offset from said sidewalls.

23. The device of claim 22 wherein said upper portion of said first portion has a rim surrounding said applicator surface, said rim defining said offset.

24. The device of claim 12 wherein said upper portion of said second portion has sidewalls, and wherein said blade is offset from said sidewalls.

25. The device of claim 24 wherein said upper portion of said second portion has a rim surrounding said blade, said rim defining said offset.

26. The device of claim 15 wherein said mounting means has sidewalls, and wherein said exposed sponge is offset from said sidewalls.

27. The device of claim 26 wherein said mounting means has a rim surrounding said exposed sponge, said rim defining said offset.

28. The device of claim 15 wherein said blade mount has sidewalls, and wherein said blade is offset from said sidewalls.

29. The device of claim 28 wherein said blade mount has a rim surrounding said blade, said rim defining said offset.

30. A device for applying a hardenable liquid to a glass windowpane surrounded by a frame to be coated with a flowable agent, said device comprising:

an applicator portion having a container for said liquid, an applicator mount having sidewalls adapted for sliding along and against said frame, and an applicator surface carried in said applicator mount and disposed to contact said pane offset from said sidewalls of said applicator mount for applying a thin film of said liquid to said pane leaving a gap of exposed glass between said film and said frame as one of said sidewalls slides along and against said frame, said frame, said gap, and a portion of said film being subsequently coated with said flowable agent; and a scraper portion having a hollow interior for removeably receiving and covering said applicator surface, a blade mount having sidewalls adapted for sliding along and against said frame, and a blade carried in said blade mount and disposed to contact said pane offset from said sidewalls of said blade mount for scraping said film together with any of said agent thereon from said pane without contact with the agent coating said gap as one of said sidewalls of said blade mount slides along and against said frame.

31. A device as claimed in claim 30 further comprising a cap having a hollow interior for removeably receiving and covering said blade.

32. A device for applying a hardenable liquid to a glass windowpane surrounded by a frame to be coated with a flowable agent, said device comprising:

an applicator portion having a container for said liquid, an applicator mount having sidewalls adapted for sliding along and against said frame, an applicator surface carried in said applicator mount and surrounded by a rim of said applicator mount such that said applicator surface is in continuous contact with said windowpane at a distance from said frame as one of said sidewalls of said applicator portion slides along and against said frame for applying a thin film of said liquid to said pane leaving a gap of exposed glass between said film and said frame, said frame, said gap and a portion of said film being subsequently covered with said flowable agent; and a scraper portion having a hollow interior for removeably receiving and covering said applicator surface, said scraper portion resting on said rim surrounding said applicator surface forming a substantially continuous external surface with said container, a blade mount having sidewalls adapted for sliding along and against said frame, and a blade carried in said blade mount surrounded by a rim of said blade mount such that said blade is in substantially continuous contact with said pane as one of said sidewalls of said blade mount slides along and against said frame for scraping said film together with any of said agent thereon from said pane without contact with the agent coating said gap.

33. The device of claim 32 further comprising a cap having a hollow interior for removeably receiving and covering said blade, said cap resting on said rim of said blade mount and forming a substantially continuous exterior surface with said scraper portion.

34. A method for masking selected portions of a glass pane mounted in a frame to be covered with a flowable agent comprising the steps of:

applying a hardenable liquid over a portion of said pane using an applicator having a container for said hardenable liquid and an applicator surface offset from an edge of said container by running a side of said container along said frame such that a gap of exposed glass is left between said frame and the hardenable liquid applied to said pane;

permitting said hardenable liquid to harden on said pane thereby forming a protective film over said portion of said pane;

coating said frame with said flowable agent such that said coating of flowable agent extends over said gap and onto said film; and removing said film and any agent thereon from said pane thereby leaving a border of said agent adjacent said frame on said pane for sealing said pane in said frame.

35. A method as claimed in claim 34 wherein said gap is approximately 1/32 of an inch.

36. A method for masking selected portions of a glass pane mounted in a frame to be covered with a flowable agent, said method using an applicator having a container with sidewalls and an applicator surface and a scraper blade respectively offset from said sidewalls by substantially the same distance, said method comprising the steps of:

running one of said sidewalls of said container along an edge of said frame with said applicator surface in contact with said pane for applying a film of hardenable liquid over a portion of said pane spaced from said frame by a gap of exposed glass defined by said offset;

permitting said hardenable liquid to harden on said pane thereby forming a protective film over said portion of said pane;

coating said frame with said flowable agent such that said coating extends over said gap and onto said hardened film; and running a sidewall of said container again along an edge of said frame with said blade in contact with said pane for removing said film and any flowable agent thereon from said pane and leaving a border of flowable agent on said pane defined by said offset for sealing said pane in said frame.

37. A method as claimed in claim 36 wherein said scraper blade is carried on a holder adapted to fit over said applicator surface, and comprising the additional step of:

covering said applicator surface with said holder for said scraper blade after applying said hardenable liquid to said pane and before removing said film from said pane.

* * * * *